US005098447A

United States Patent [19]

Zucchini et al.

[11] Patent Number: 5,098,447

[45] Date of Patent: Mar. 24, 1992

[54] PROCESS FOR BLEACHING AND STERILIZING CORK ARTICLES, AND CORK ARTICLES BLEACHED USING THE SAID PROCESS

[75] Inventors: Giovanni Zucchini, Rosignano-Solvay; Amerigo Donati, Rosignano M.MO, both of Italy

[73] Assignee: Interox Chimica S.p.A., Rosignano-Solvay, Italy

[21] Appl. No.: 292,169

[22] Filed: Dec. 30, 1988

[30] Foreign Application Priority Data

Dec. 30, 1987 [IT] Italy ..... 23281 A/87

[51] Int. Cl.[5] ..... D06L 3/04

[52] U.S. Cl. ..... 8/103; 8/111; 134/1; 134/27; 422/24

[58] Field of Search ..... 8/111; 134/103, 27, 134/29, 1; 422/24

[56] References Cited

U.S. PATENT DOCUMENTS 4,289,728 9/1981 Peel et al. ..... 422/24
4,693,757 9/1987 Sabate et al. ..... 134/27

FOREIGN PATENT DOCUMENTS 3539715 6/1986 Fed. Rep. of Germany .
2569369 2/1986 France .
1126233 9/1968 United Kingdom .

*Primary Examiner*—Prince Willis, Jr.
*Assistant Examiner*—John F. McNally
*Attorney, Agent, or Firm*—Spencer & Frank

[57] ABSTRACT

Cork articles are bleached by a treatment by means of an alkaline aqueous solution of hydrogen peroxide and by drying the articles, impregnated with hydrogen peroxide, in the presence of an ultraviolet radiation. No figure.

11 Claims, No Drawings

PROCESS FOR BLEACHING AND STERILIZING CORK ARTICLES, AND CORK ARTICLES BLEACHED USING THE SAID PROCESS

The present invention relates to a process for bleaching and sterilizing cork articles by means of an aqueous solution of hydrogen peroxide.

It has been known for many years to bleach and to sterilize cork articles by means of alkaline aqueous solutions of hypochlorite. Processes of this kind sometimes present the disadvantage of yielding cork articles which, even after washing, still contain small quantities of chlorine in the form of organic compounds. These compound may be the cause of unpleasant smells and may corrupt the taste of foodstuffs which are placed in contact with the articles bleached in this way. To overcome these disadvantages it has been proposed to beach cork articles with hydrogen peroxide, with the aim of eliminating the formation of chlorinated organic compounds. French patent application No. FR-A1-2,569,369 provides a process for bleaching cork articles in four stages consisting, in a first stage, in treating the articles with an aqueous solution containing hydrogen peroxide, a stabilizer for the latter and an alkaline substance, in a second stage, in washing the articles with water, in a third stage, in treating the articles with an aqueous solution of an acidic substance and, in a fourth stage, in drying the articles. However, this process introduces the disadvantage of requiring a complex, multistage treatment making use of acidic and basic solutions and not permitting the cork articles to be bleached to a sufficiently high degree of whiteness which is required by most of the uses of these articles.

The invention overcomes these disadvantages of the known processes by providing a new process for bleaching and for sterilizing cork articles with the aid of an aqueous solution of hydrogen peroxide which makes it possible to obtain higher whitenesses and which does not require intermediate stages of treatment of the articles between the bleaching stage and the drying stage.

To this end, the invention relates to a process for bleaching and sterilizing cork articles by means of an alkaline aqueous solution of hydrogen peroxide, according to which, after treatment of the articles with the hydrogen peroxide solution, the articles, impregnated with hydrogen peroxide, are dried in the presence of an ultraviolet radiation.

The cork articles to which the process according to the invention applies are decorative objects or objects of use—it is immaterial which—consisting, at least for the most part of their structure of the natural product which is the cork obtained from the bark of cork oaks.

An alkaline aqueous solution of hydrogen peroxide is intended to mean an aqueous solution which contains at least one alkaline substance and hydrogen peroxide. In general, solutions which contain from 10 to 300 g $H_2O_2$ per liter are suitable for the use of the process according to the invention. Advantageously, solutions which contain from 30 to 150 g $H_2O_2$ per liter are employed.

The alkaline substance employed in the aqueous solution is an inorganic chemical compound capable of fixing the pH of the solution in the alkaline region above 8.5 when it is dissolved in water. One of these compounds may be employed by itself; it is also possible to incorporate a mixture of several of these compounds in the solution. Buffer mixtures of alkaline substances may, for example, be employed.

The dosage of alkaline substance to be incorporated in the solution of hydrogen peroxide will be advantageously chosen so that the pH of the solution settles in the range of between 9.0 to 10.5.

Alkaline substances which have given good results are alkali metal hydroxides, carbonates and phosphates, employed separately or as mixtures. The best results have been obtained with sodium hydroxide employed in a proportion of 2 to 20 g/l of hydrogen peroxide solution or with sodium carbonate in a proportion from 5 to 50 g/l of solution.

According to the invention, the aqueous solution of hydrogen peroxide may also contain one or more additives which are usually employed in bleaching solutions, such as, for example, stabilizers for hydrogen peroxide, surface-active agents, optical whiteners, viscosity or pH regulators, corrosion inhibitors and cork-protecting agents.

It is advantageous to employ a stabilizer in the hydrogen peroxide solution in the process according to the invention.

Any kind of known stabilizer for preventing the premature decomposition of hydrogen peroxide to oxygen and water may be incorporated in the hydrogen peroxide solution as a stabilizer. Examples of such stabilizers are sodium silicate, alkali metal polyphosphates, organic stabilizers belonging to the class of polyphosphonates or to that of aminopolycarboxylic acids and their salts. Sodium silicate, employed in a proportion of 2 to 50 g/l of solution, has given good results and is preferred because of its ready availability and its relatively low cost.

Utilization of a surface-active agent in the hydrogen peroxide solution employed in accordance with the invention is frequently found to be useful for improving the impregnation of the cork articles with the hydrogen peroxide solution. To this end, it is desirable to employ a surface-active agent which is insert towards the hydrogen peroxide present in the alkaline aqueous solution. Surface-active agents which fit in with this wish generally belong to the classes of anionic or non-ionic surfactants such as, for example, polyalkoxylated alcohols containing a linear carbon chain.

The bleaching process according to the invention comprises two successive stages : a first stage consisting in treating the cork articles with the aqueous solution of hydrogen peroxide, and a second stage consisting in drying the articles treated in the first stage.

In the process according to the invention, the drying stage is carried out by any known drying means or apparatus such as drying with hot air in a ventilated oven, drying by exposure to infrared radiation, or drying under partial vacuum.

The drying time and temperature are generally not critical. They depend on the drying technique which is chosen, on the surface porosity of the cork articles and on the power of the UV irradiation. They may be readily determined by a series of laboratory experiments within the scope of the person skilled in the art. Drying times of between 2 and 10 hours and temperatures situated in the range from 15° to 95° C. are generally suitable when the drying is carried out at atmospheric pressure.

According to the invention, the drying is carried out on cork articles which are impregnated with hydrogen peroxide and in the presence of an ultraviolet radiation.

For this purpose, in accordance with the invention, it is recommended not to subject the dark articles to an intensive washing between the stage of treatment with the hydrogen peroxide solution and the drying stage. The procedure which is generally preferred consists in subjecting the cork articles to a simple drip drying between these two stages, expressly avoiding washing them, even partially.

It is generally advantageous that the cork articles should still contain more than 0.05 g $H_2O_2$/100 g of cork and, preferably, more than 0.10 g $H_2O_2$/100 g of cork when exposure to UV radiation commences in the drying stage. In principle, there is no upper limit to the quantity of hydrogen peroxide impregnating the cork stoppers. In practice, quantities of between 0.1 to 1 g/100 g are suitable in most cases.

Ultraviolet radiation is intended to mean an electromagnetic radiation whose wavelength is within the range starting at 200 nm and ending at 350 nm and whose power is at least 3 watts. This radiation is produced by means of electric lamps containing a metal vapour, which are well known in industry, especially in disinfecting techniques.

In the process according to the invention, the cork articles may be subjected to the action of the ultraviolet radiation throughout the drying period.

In an alternative form of the process according to the invention, the cork articles are subjected to the ultraviolet radiation for only a fraction of the drying stage, preferably during the first part of the drying. For example, after an irradiation for 2 to 6 hours in the presence of ultraviolet, the drying is continued in the absence of UV radiation.

In the abovementioned first stage of the process according to the invention, the contact between the aqueous solution of hydrogen peroxide and the cork articles may be produced in any way according to the various methods which are already known per se. A contacting technique which has given good results in the technique of immersing the cork articles in a bleaching bath consisting of the solution of hydrogen peroxide for a determined time during which the articles may advantageously be stirred in the solution. An embodiment in accordance with this technique consists, for example, in placing the articles in a basket with a perforated or porous wall, immersing the basket in the hydrogen peroxide solution and in imparting to it an alternating rotary motion at a slow speed during the initial stage of the treatment.

Another technique for contacting the cork articles with the hydrogen peroxide solution consists in depositing the articles on a porous surface and in spraying the hydrogen peroxide solution onto them by sprinkling with the aid of a jet of solution which scans the whole surface of the articles to be treated. The hydrogen peroxide solution is collected under the porous surface supporting the cork articles and is recycled towards the spraying device.

An advantageous method of bringing the cork articles into contact with the hydrogen peroxide solution consists in placing the articles in a basket with a perforated or porous wall, in suspending the basked above the hydrogen peroxide solution containing a surface-active agent with high foaming power, and in then injecting air into the hydrogen peroxide solution so as to cause the formation of an upward flow of foam which reaches the articles in the basket. The concentration of surfactant, the solution temperature and the flow of injected air are controlled so that, in a stationary operating regime, the flood of foam overflows the basket containing the cork articles, and then breaks and falls back into the solution. This technique offers the advantage of consuming less energy than the techniques, already described, of immersing or spraying the articles to be treated. In addition, it makes it unnecessary to use foam suppressors, which are frequently necessary with the other techniques.

The invention applies to all cork articles. In particular, it applies advantageously to tiles, panels and sheets of cork, and to cork stoppers employed in the bottling industry. It finds a particularly advantageous application for bleaching the cork stoppers employed in the food industry, most especially for closing bottles containing liquids such as wine, cider and spirits.

When applied to the bleaching of stoppers, the process according to the invention offers the advantage of simplicity when compared with the conventional processes employing hypochlorite, which require a washing stage. It also makes it possible to obtain a more advanced degree of bleaching than the known processes employing hydrogen peroxide and, in particular, improves the clarity of stamp printing of the stoppers intended for alimentary use. In general, the use of the process according to the invention makes it possible to eliminate all the chemical agents employed in the known processes in the stopper washing stage, such as citric and tartaric acids, sulphites and hydrochloric acid.

The invention also relates to the cork articles treated according to the process described above. In particular, it relates to cork stoppers, particularly those employed for closing bottles and flasks of wine and spirits.

The invention will now be described, without any limitation being implied, by means of the concrete examples which follow.

EXAMPLES 1 TO 3 (ACCORDING TO THE INVENTION)

An aqueous solution of hydrogen peroxide was prepared in a 1,000 ml glass beaker by dissolving in water at 70° C. a sufficient quantity of a commercial solution of hydrogen peroxide at a concentration of 35 g/100 g of solution, to give a $H_2O_2$ concentration of 100 /gl. An adjusted volume of N NaOH was then dissolved in it to give, after homogenizing, a concentration of 10 g NaOH/L. The pH of the alkaline aqueous solution of hydrogen peroxide thus obtained was 9.7.

In text 1, a hydrogen peroxide solution containing no stabilizer was employed. In the case of tests 2 and 3, 38° BÉ sodium silicate was incorporated in the hydrogen peroxide solution as a stabilizer, in quantities of 7 g/l (test No. 2) and 70 g/l (test No. 3), respectively.

The unbleached cork stoppers were enclosed in a metal basket made of stainless steel and provided with many openings and then the basket was immersed in the beaker containing the aqueous hydrogen peroxide solution and was left therein for 1 hour while the solution was stirred continuously with the aid of a magnetic stirrer adjusted to 100 revolutions/minute.

After treatment with the aqueous hydrogen peroxide solution, the cork stoppers were withdrawn from the metal basket, were drained, and were arranged, without being washed, in a ventilated oven in which the warm air stream was adjusted to 50° C. and which contained a generator of UV radiation in the form of 3 Philips TUV-6W type luminous tubes. The drying was then continued in this oven in the presence of the UV radiation for 180 minutes.

The bleached and dried stoppers were then subjected to a measurement of whiteness by means of a Photovolt reflectometer. The results of the whiteness measurements made it possible to calculate for each stopper, by subtracting the whiteness measured before treatment, the gain in whiteness, expressed in Photovolt degrees. The results obtained have been summarized in Table I which follows, which shows the ranges of gains in whiteness which were obtained.

EXAMPLES 4R TO 6R (REFERENCE EXAMPLES)

By way of comparison, Table I also shows the results obtained with a process not according to the invention, which employs a water washing stage between the first stage of treatment with hydrogen peroxide and the drying stage. Al the other operating conditions are identical with those in Examples 1 to 3. Test 4 R used no stabilizer in the first stage, 7 and 70 g/l of silicate were used in tests 5 R and 6 R respectively, as in tests 2 and 3.

TABLE I

| Test No. | Silicate, g/l | Washing | Whiten. gain, °PHOT |
|---|---|---|---|
| 1 | 0 | no | 15 to 18 |
| 2 | 7 | no | 17 to 18 |
| 3 | 70 | no | 19 to 20 |
| 4R | 0 | yes | 9 to 11 |
| 5R | 7 | yes | 9 to 11 |
| 6R | 70 | yes | 13 to 15 |

The superior effectiveness of the process according to the invention can be seen.

EXAMPLES 7 R AND 11 R (REFERENCE EXAMPLES)

In order to provide reference points, the results obtained with the following processes not according to the invention are shown in Table II:

tests 7R and 8R: drying without UV irradiation;

test 9R: no UV irradiation during drying; UV irradiation after drying;

test 10R: no first stage with $H_2O_2$;

test 11R: first alkaline stage without $H_2O_2$.

TABLE II

| Test No. | Stage | Silicate, g/l | Washing | UV | Whiten. gain, °PHOT |
|---|---|---|---|---|---|
| 7R | $H_2O_2$ | 0 | no | no | 14 to 15 |
| 8R | $H_2O_2$ | 0 | yes | no | 9 to 10 |
| 9R | $H_2O_2$ | 7 | no | yes* | 12 to 13 |
| 10R | non | 0 | no | yes | −3 to −2 |
| 11R | NaOH | 0 | no | yes | −4 |

*irradiation after drying.

These results show that none of the processes of Examples 4R to 11R, not according to the invention, produces degrees of whiteness as high as those obtained in Examples 1 to 3, in accordance with the invention.

We claim:

1. A process for bleaching cork articles comprising:

impregnating said cork article with an alkaline aqueous hydrogen peroxide solution to obtain impregnated cork articles containing more than 0.05 g $H_2O_2$/100 g of cork, said solution having a ph above about 8.5 and containing from about 10 to about 300 grams of hydrogen peroxide per liter; and drying said cork impregnated articles while subjecting said articles to the action of ultraviolet radiation generated by an artificial source for at least 2 hours at wavelengths from about 200 nm to about 350 nm.

2. Process according to claim 1, characterized in that the solution of hydrogen peroxide contains a compound which stabilizes the hydrogen peroxide.

3. Process according to claim 2, characterized in that the stabilizer is sodium silicate, employed in a proportion of 2 to 50 g/l of solution.

4. Process according to claim 1, characterized in that the solution of hydrogen peroxide contains 30 to 150 g $H_2O_2$ per liter.

5. Process according to claim 1, characterized in that the alkalinity of the solution of hydrogen peroxide is such that its pH is between 9.0 and 10.5.

6. Process according to claim 1, characterized in that the alkalinity of the solution of hydrogen peroxide is obtained by the use of 2 to 20 g of sodium hydroxide per liter.

7. Process according to claim 1, characterized in that the alkalinity of the solution of hydrogen peroxide is obtained by the use of 5 to 50 g of sodium carbonate per liter.

8. Cork articles bleached according to the process in accordance with claim 1.

9. A process for bleaching cork articles, consisting essentially of:

impregnating said cork article with an alkaline aqueous hydrogen peroxide solution to obtain impregnated cork articles containing more than 0.05 g $H_2O_2$/100 g of cork, said solution having a ph above about 8.5 and containing from about 10 to about 300 grams of hydrogen peroxide per liter; and subjecting said articles impregnated with hydrogen peroxide to the action of ultraviolet radiation generated by an artificial source for about 2 to about 6 hours at wave lengths from about 200 nm to about 350 nm and drying bleached articles.

10. The process according to claim 1, wherein said articles are impregnated with hydrogen peroxide for about 1 hour.

11. The process according to claim 9, wherein said articles are impregnated with hydrogen peroxide for about 1 hour.

* * * * *